US005813445A

United States Patent [19]

Christman

[11] Patent Number: 5,813,445

[45] Date of Patent: Sep. 29, 1998

[54] BINGO TOTE BAG

[76] Inventor: Lynn R. Christman, 1101 W. Main St., Grove City, Pa. 16127

[21] Appl. No.: 772,421

[22] Filed: Dec. 23, 1996

[51] Int. Cl.[6] ..... A45C 3/00; A45C 11/32; A45C 15/00

[52] U.S. Cl. ..... 150/106; 150/112; 206/315.1; 383/38

[58] Field of Search ..... 150/106, 112, 150/117, 113; 206/315.1, 579, 217; 190/1, 2, 109–111; 383/38

[56] References Cited

U.S. PATENT DOCUMENTS

| | | | |
|---|---|---|---|
| D. 276,954 | 1/1985 | Kruger | D3/43 |
| D. 342,638 | 12/1993 | Harland | D6/601 |
| 2,447,940 | 8/1948 | Holland | 150/112 |
| 2,717,015 | 9/1955 | Berry | 190/111 X |
| 3,117,607 | 1/1964 | Siegel | 150/117 |
| 3,871,519 | 3/1975 | Groomes | 206/223 |
| 4,161,201 | 7/1979 | Carp | 150/113 X |
| 4,192,365 | 3/1980 | Siegel | 150/117 X |
| 4,301,898 | 11/1981 | Plough et al. | 150/117 X |
| 4,506,769 | 3/1985 | Franco et al. | 190/110 X |
| 4,566,130 | 1/1986 | Coates | 190/1 X |
| 4,646,804 | 3/1987 | Damiano | 150/112 |
| 4,712,673 | 12/1987 | Moore | 190/1 X |
| 4,739,809 | 4/1988 | Adams | 150/112 |
| 4,977,941 | 12/1990 | Henderson | 150/112 |
| 5,046,860 | 9/1991 | Brennan | 150/112 X |
| 5,054,783 | 10/1991 | Hull et al. | 206/315.1 X |
| 5,190,377 | 3/1993 | Kelly | 383/39 |
| 5,265,719 | 11/1993 | Wand | 190/111 X |
| 5,595,302 | 1/1997 | Maydwell et al. | 206/579 X |

FOREIGN PATENT DOCUMENTS

| | | | |
|---|---|---|---|
| 985551 | 7/1951 | France | 150/112 |
| 2641170 | 7/1990 | France | 150/112 |

*Primary Examiner*—Sue A. Weaver
*Attorney, Agent, or Firm*—Aileen-Champion Addessi

[57] ABSTRACT

A bingo tote bag includes several interior and exterior compartments that enable a bingo player to organize and carry bingo supplies and other items in a single tote bag, replacing the bingo player's old tote, lunch bag, and purse. The bingo tote bag includes eight exterior pockets, four positioned on each side of the tote bag, for storage of daubers of various colors. One side pocket is positioned at each end of the bingo tote bag for storage of eye glasses, pencils, magnetic bingo wands, and glue sticks. The interior compartments include an insulated beverage holder, a key ring holder, additional pockets, and an attached wallet. The interior space of the bingo tote bag is large enough for carrying food, candy, and good luck charms. The tote bag also includes shoulder straps.

20 Claims, 2 Drawing Sheets

BINGO TOTE BAG

BACKGROUND OF THE INVENTION

The invention relates to handbags and, more particularly, to a bingo tote bag having several pockets, compartments and retaining means for organizing and storing various accessories associated with playing the game of Bingo.

The game of bingo is enjoyed by individuals of all ages and is widely played at various establishments, such as churches, clubs, or the like. Playing bingo requires the use of bingo cards, bingo markers, magnetic wands, daubers (special large markers in various colors which are utilized in playing paper bingo games), pencils, tablets, or the like. In addition, bingo players also carry to the bingo game items such as eye glasses, food, candy, beverages, umbrella, keys, purse, wallet, good luck charms, etc. It is cumbersome to carry several bags containing all of these items, and is difficult to easily locate a particular item mixed in with all of the other bingo accessories.

There are several kinds of bingo bags. One such device is disclosed in U.S. Pat. No. 5,190,377 issued Mar. 2, 1993 to Kelly and entitled "Bingo Purse". The bingo purse includes several pockets positioned about an exterior surface of the purse for holding bingo items, such as daubers, glasses, and pencils. A separate drawstring pouch may be carried within the bingo purse for holding bingo chips. However, the bingo bag does not have an attached wallet compartment for storage of money, identification or other purse items, or an attached holder for retaining a beverage container or a key ring.

U.S. Pat. No. 4,977,941 to Henderson and entitled "Bingo Bag with Self-Supporting Vertical Wall" and U.S. Pat. No. 4,646,804 to Damiano and entitled "Handbag for Playing Bingo" disclose bingo bags having several pockets positioned about an interior surface of the bag for holding various bingo items. However, the bingo bags do not have an attached wallet compartment, or an attached holder for a beverage or a key ring.

Therefore, what is needed is a bingo tote bag for organizing and storing bingo accessories which utilizes both interior and exterior pockets for storing small bingo items, a large central area for storing a bingo player's snacks and good luck charms, a means for retaining a beverage container, and means for retaining keys in an accessible location.

SUMMARY OF THE INVENTION

A bingo tote bag includes at least one sidewall having a top portion and a bottom portion, and a base member secured to the bottom portion of the sidewall for forming a container having an open end. At least one panel is attached to the sidewall forming a plurality of pockets for storing bingo game accessories. The panels may be disposed about and within the bingo tote bag for forming pockets on an exterior and an interior surface of the bingo tote bag. A wallet compartment, a beverage holder, and a key ring holder are disposed within the bingo tote bag and secured to the sidewall. A handle is attached to the top portion of the wall for carrying the bingo tote bag.

The bingo tote bag may further include a rigid support disposed within the bingo tote bag and positioned adjacent to the base member for strengthening the tote bag, and an interfacing positioned between first and second pieces of fabric for providing support to the walls. The key ring holder includes a fastener for removably securing objects within the key ring holder. The beverage holder may be formed of a thermally insulated material. The wallet compartment includes a plurality of pockets sized and adapted for storing identification, coins, and paper money.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

Figure 1:
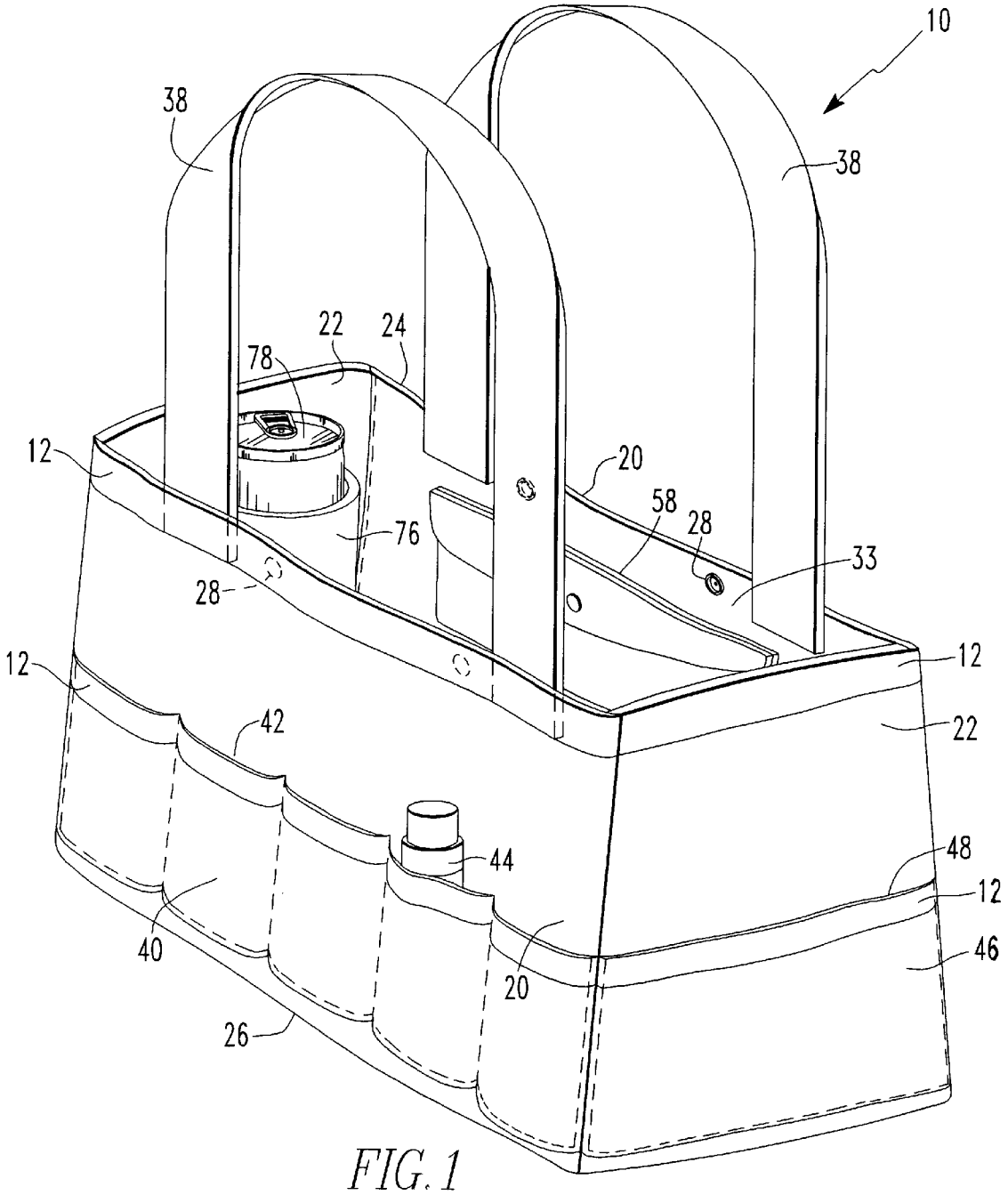
FIG. 1 is a perspective view of a bingo tote bag.
Figure 2:
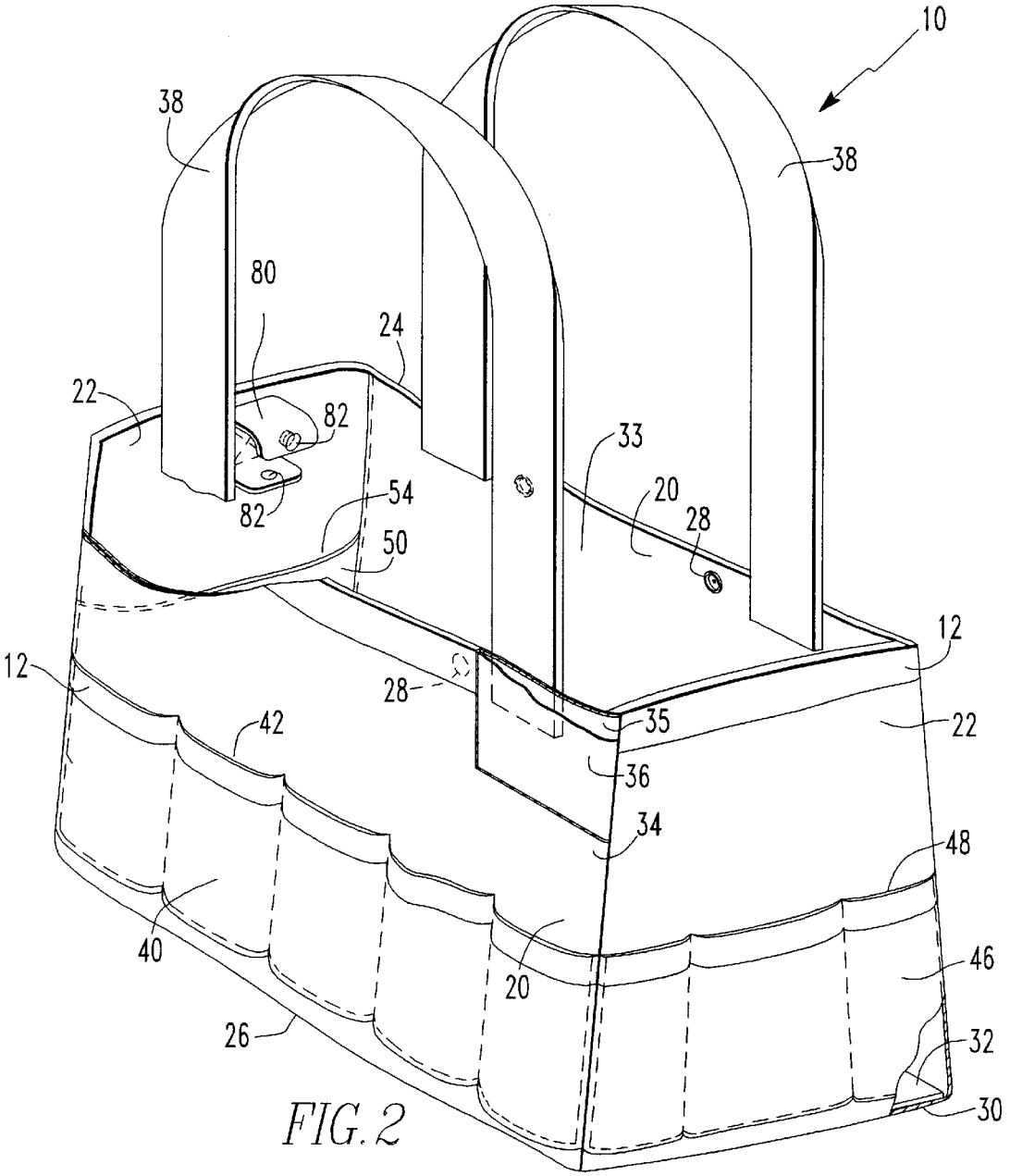
FIG. 2 is a perspective view illustrating an opposite side of the bingo tote bag.
Figure 3:
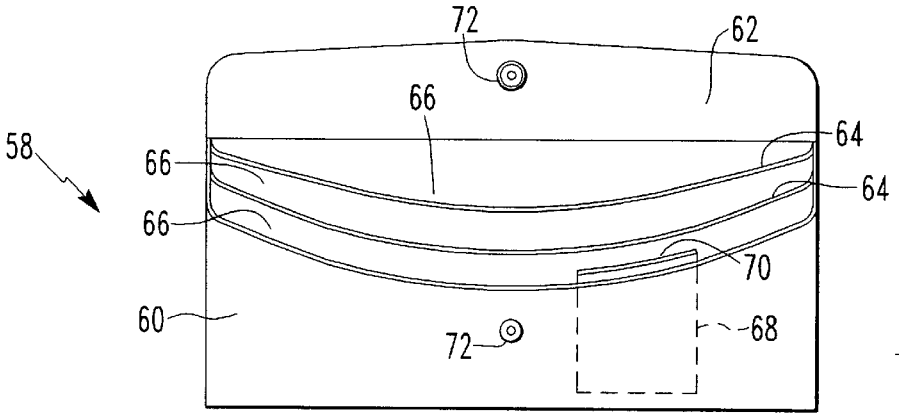
FIG. 3 is a perspective view showing a wallet compartment in an open position.

Referring to FIGS. 1–3, a bingo tote bag 10 is constructed of fabric, vinyl, leather, or other suitable material, having the components attached together by sewing, double stitching, adhesively, or the like. The fabric may be treated with a stain resistant product for protecting the tote bag 10 from ink stains from the daubers, beverage and food stains, etc. As illustrated in FIG. 1, additional pieces of contrasting decorative fabric 12 may be attached to the bingo tote bag 10 for enhancing the aesthetic appearance of the tote bag 10.

The bingo tote bag 10 has a plurality of sidewalls, such as a pair of first walls 20 each positioned at a side of the bingo tote bag 10 and a pair of second walls 22 each positioned at an end of the bingo tote bag 10. The first and second walls 20 and 22 are attached together for forming an annular piece of material. Alternatively, the first and second walls 20 and 22 may be integrally formed together as one piece, having opposite ends attached together. The side walls 20 and end walls 22 have a top portion 24, a bottom portion 26, an interior surface and an exterior surface. The top portion 24 may have a fastener 28 including a first mating connection engagable with a second mating connection, such as snaps, a zipper, fibrous adhesive patches marketed under the tradename Velcro, or the like.

A base member 30 is attached to the bottom portion 26 of the first and second walls 20 and 22 for forming a bottom of the tote bag 10. Preferably, the base member 30 has a rectangular shape for forming a rectangularly shaped bingo tote bag 10.

A rigid support 32, such as a rectangular piece of plastic, cardboard or the like, is positioned adjacent to the base member 30 within the bingo tote bag 10 for strengthening the construction of the tote bag 10. The rigid support 32 is removable for washing the fabric tote bag 10.

The base member 30 in combination with the sidewalls 20 and 22 form a container or bag 10 having one open end at the top portion 24 and having an interior compartment area 33 for storing various items, such as food, candy, good luck charms, bingo chips, or the like. The sidewalls 20 and 22 may be formed of two pieces of fabric, such as a first fabric 34 and a second fabric 35, having interfacing 36 positioned therebetween for strengthening the walls of the tote bag 10.

A handle 38 is attached to the top portion 24 of at least one of the first and second walls 20 and 22. Preferably, the handle 38 is a pair of shoulder straps, each attached to one of the first walls 20 for enabling a person to carry the bingo tote bag 10 by placing the straps over one shoulder.

At least one panel is attached to the sidewalls 20 and 22 of the bingo tote bag 10 for forming pockets. As an example, a first panel 40 is attached to each of the first walls 20 for forming a series of pockets 42 on an exterior surface of the tote bag 10. The panel 40 may be stitched to the first wall 20 intermittently and in spaced apart relation to one another for forming several pockets 42 with one panel 40. The pockets 42 may be used to store daubers 44 or other bingo accessories. A second panel 46 is attached to each of the second walls 22 for forming pockets 48 on an exterior surface of the tote bag 10. The pockets 48 may be used to hold magnetic wands, pencils, glasses, glue sticks, or other similar items. Alternatively, the panels 40 and 46 may be integrally formed together as one piece. FIG. 1 illustrates one embodiment of the size and positioning of the panels 40 and 46 on the first and second walls 20 and 22, and FIG. 2 illustrates an alternative embodiment.

A third panel 50 is attached to one of the first and second walls 20 for forming a pocket 54 on an interior surface of the bingo tote bag 10. The pocket 54 may be used for storing an umbrella, additional daubers, or other items. Alternatively, additional panels 50 may be attached to the sidewalls for forming several pockets 54 within the tote bag 10.

A wallet compartment 58 is attached to one of the first and second walls 20 and 22 so that the wallet compartment 58 is positioned within the bingo tote bag 10. The wallet compartment 58 includes at least one piece of fabric or other suitable material attached together in a manner so that an envelope enclosure 60 is formed having a flap 62 and a plurality of partitions which form several pockets or compartments. As one example, the wallet compartment 58 has two partitions 64 forming three pockets 66, and an additional panel 68 forming a pocket 70. The pockets 66 are sized and adapted for containing paper money, coins, comb, lipstick, or the like. The pocket 70 is sized and adapted for housing identification, such as a driver's license, credit cards, or the like. The flap 62 may be secured by a fastener 72 which may include a first mating connection engagable with a second mating connection, such as a snap, zipper, fibrous adhesive patches marketed under the tradename Velcro, or the like, for protecting the contents of the wallet.

A beverage holder 76 is attached to one of the first and second walls 20 and 22 on an interior surface of the bingo tote bag 10 for holding a beverage container 78 in a stationary upright position. The beverage holder 76 may be formed of a thermally insulated material for maintaining the temperature of the beverage. The beverage holder 76 may be an annularly shaped piece of material which is stitched to one of the second walls 22 and has at least one open end. The annularly shaped piece of material is sized and adapted to enable a beverage container to be disposed therein.

A key ring holder 80 is attached to one of the first and second walls 20 and 22, preferably on an interior surface of the bingo tote bag 10 for holding keys. The key ring holder 80 has a fastener 82 having a first and second engagable mating connection for enabling a key ring to be removably attached to the bingo tote bag 10. As one example, the key ring holder 80 may be a strip of material, having a portion attached to the sidewall of the tote bag and opposite ends attached to one of the mating connections of the fastener 82. The fastener 82 may be a snap, fibrous adhesive patches marketed under the tradename Velcro, or the like. Alternatively, the key ring holder 80 may be two pieces of material, each having one end attached to the sidewall of the tote bag and an opposite end attached to the fastener 82.

An advantage of the bingo tote bag 10 is that it replaces a bingo player's old tote, lunch bag, and purse making carrying of bingo supplies a much easier task. The user is also able to carry many items with ease due to the strong canvas material, supportive base, and approximate size of the tote bag of 18 inches long by 13 ½ inches wide. The numerous pockets, compartments, and holding means keep the various bingo accessories organized and easily accessible to the bingo player.

Thus there has been shown and described a novel bingo tote bag which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A bingo tote bag, comprising:

at least one wall secured together for forming sidewalls and end walls of said bingo tote bag, said wall having a top portion and a bottom portion;

a base member secured to said bottom portion of said wall forming a container having an open end;

at least one first panel attached to said bottom portion of said wall forming a plurality of pockets on each of said sidewalls and at least one pocket on each of said end walls on an exterior surface of said bingo tote bag for storing bingo game accessories;

a second panel attached to an interior surface of said bottom portion of said wall on one of said end walls forming at least one pocket for storing bingo game accessories within said bingo tote bag;

a wallet compartment disposed within said bingo tote bag and secured to said top portion of one of said sidewalls;

a beverage holder including an elongated cylinder formed of a piece of material and having at least one open end, said beverage holder disposed within said bingo tote bag and having said elongated cylinder secured to one of said end walls with said open end facing in the same direction as said open end of said container for insertion and storage of a beverage container in an upright position during use of said bingo tote bag;

a key ring holder secured to at least one of said end walls and said sidewalls; and a handle attached to said top portion of said wall for carrying said bingo tote bag.

2. The bingo tote bag according to claim 1, further comprising a rigid support disposed within said bingo tote bag and positioned adjacent to said base member for strengthening said tote bag.

3. The bingo tote bag according to claim 1, wherein said sidewall comprises:

a first fabric member;

a second fabric member positioned adjacent to said first fabric; and an interfacing positioned therebetween for providing support to said sidewalls.

4. The bingo tote bag according to claim 1, wherein said handle includes a pair of shoulder straps.

5. The bingo tote bag according to claim 1, further comprising a decorative fabric attached to said sidewall.

6. The bingo tote bag according to claim 1, wherein said key ring holder includes a fastener for removably securing objects within said key ring holder.

7. The bingo tote bag according to claim 1, wherein said beverage holder is formed of a thermally insulated material.

8. The bingo tote bag according to claim 1, wherein said wallet compartment comprises:

at least one partition forming a plurality of pockets sized and adapted for storing identification, coins, and paper money; and a fastener attached to said wallet compartment for securing the identification, coins and paper money within said wallet compartment.

9. A bingo tote bag, comprising:

at least one wall secured together for forming sidewalls and end walls of said bingo tote bag, said wall having a top portion and a bottom portion;

a base member secured to said bottom portion of said wall forming a container having an open end;

at least one panel disposed about said wall and attached, intermittently and in spaced apart relation, to said wall forming a plurality of pockets on an exterior surface of said bingo tote bag for storing bingo game accessories;

at least one additional panel disposed within said bingo tote bag and attached to said wall for forming at least one pocket on an interior surface of said bingo tote bag;

a wallet compartment, disposed within said bingo tote bag and secured to said wall, being an enclosure with a plurality of partitions contained within and forming pockets therebetween for storing money, said wallet compartment having a piece of material attached to one of said partitions forming a pocket sized and adapted to store identification, said wall compartment having a fastener attached to said enclosure for securing the money and identification within said wallet compartment;

a beverage holder, disposed within said bingo tote bag and secured to said wall, formed of an annularly shaped piece of material sized and adapted for retaining a beverage container, said piece of material being a thermally insulated material for substantially maintaining the temperature of a beverage;

a key ring holder formed of a piece of material sewn onto said wall, and having a fastener attached to said piece of material and engagable with a key ring for removably storing keys; and a pair of shoulder straps attached to said top portion of said wall for carrying said bingo tote bag.

10. The bingo tote bag according to claim 9, further comprising a rigid support disposed within said bingo tote bag, and sized and positioned to substantially cover said base member for strengthening said tote bag.

11. The bingo tote bag according to claim 9, wherein said wall comprises:

a first fabric member;

a second fabric member positioned adjacent to said first fabric; and an interfacing positioned therebetween for providing support to said walls.

12. The bingo tote bag according to claim 9, further comprising a decorative fabric attached to said wall.

13. A bingo tote bag, comprising:

at least one wall secured together for forming sidewalls and end walls of said bingo tote bag, said wall having a top portion and a bottom portion;

a base member secured to said bottom portion of said wall forming a container having an open end;

at least one first panel disposed about and attached to said bottom portion of said at least one wall forming a plurality of pockets on an exterior surface of said bingo tote bag for storing bingo game accessories;

at least one second panel disposed within said bingo tote bag and attached to said bottom portion of said at least one wall forming at least one pocket on an interior surface of said bingo tote bag for storing items;

a wallet compartment disposed within said bingo tote bag and secured to said wall;

a beverage holder formed of an annularly shaped piece of material disposed within said bingo tote bag and secured to said wall for storage of a beverage container;

a key ring holder formed of a piece of material secured to said wall and having a fastener attached to said piece of material and engagable with a key ring for removably storing said key ring; and a handle attached to said top portion of said wall for carrying said bingo tote bag.

14. The bingo tote bag according to claim 13, further comprising a rigid support disposed within said bingo tote bag and positioned adjacent to said base member for strengthening said tote bag.

15. The bingo tote bag according to claim 13, wherein said wall comprises:

a first fabric member;

a second fabric member positioned adjacent to said first fabric; and an interfacing positioned therebetween for providing support to said walls.

16. The bingo tote bag according to claim 13, wherein said handle includes a pair of shoulder straps.

17. The bingo tote bag according to claim 13, further comprising a decorative fabric attached to said wall.

18. The bingo tote bag according to claim 13, wherein said at least one first panel forms at least five pockets positioned on each of said sidewalls on said exterior of said bingo tote bag, and at least one pocket positioned on each of said end walls on said exterior of said bingo tote bag.

19. The bingo tote bag according to claim 13, wherein said beverage holder is formed of a thermally insulated material.

20. The bingo tote bag according to claim 13, wherein said wallet compartment comprises:

at least one partition forming a plurality of pockets sized and adapted for storing identification, coins, and paper money; and a fastener attached to said wallet compartment for securing the identification, coins and paper money within said wallet compartment.

* * * * *